US006610194B1

(12) United States Patent
Guerin

(10) Patent No.: US 6,610,194 B1
(45) Date of Patent: Aug. 26, 2003

(54) BATH COMPOSITION FOR ELECTROPOLISHING OF TITANIUM AND METHOD FOR USING SAME

(75) Inventor: Jean Guerin, Divonne les Bains (FR)

(73) Assignee: European Organization for Nuclear Research (CERN), Geneve (CH)

( * ) Notice: Subject to any disclaimer, the term of this patent is extended or adjusted under 35 U.S.C. 154(b) by 0 days.

(21) Appl. No.: 10/018,822

(22) PCT Filed: Jun. 20, 2000

(86) PCT No.: PCT/FR00/01694

§ 371 (c)(1),
(2), (4) Date: Dec. 19, 2001

(87) PCT Pub. No.: WO01/00906

PCT Pub. Date: Jan. 4, 2001

(30) Foreign Application Priority Data

Jun. 25, 1999 (FR) ..... 99 08151

(51) Int. Cl.[7] ..... B23H 11/00; C25F 3/00; C25F 7/00; H05K 3/07

(52) U.S. Cl. ..... 205/678; 205/671; 205/640; 205/674; 205/675; 205/676; 205/684

(58) Field of Search ..... 216/100, 108, 216/109; 205/671, 640, 674, 675, 676, 678, 684

(56) References Cited

U.S. PATENT DOCUMENTS 4,220,509 A * 9/1980 Shtanko et al. ..... 205/675
5,378,331 A * 1/1995 Kemp ..... 205/671

OTHER PUBLICATIONS

International Search Report for PCT/FR00/01694, Nov. 2, 2000, Organisation Europeenne Pour La Recherche.

XP002132217—Abstract, Nov. 30, 1989, Kolomenskov, V. I.

XP002132218—Abstract, Nov. 15, 1981, Kanin, E. N.

XP002132219—Abstract, Jun. 23, 1991, Belgorod Constr. Material.

XP002132216—Abstract, Feb. 28, 1992, Belgorod Constr. Material.

* cited by examiner

*Primary Examiner*—Roy King
*Assistant Examiner*—Wesley A. Nicolas
(74) *Attorney, Agent, or Firm*—Marshall, Gerstein & Borun

(57) ABSTRACT

A bath composition for the electropolishing of a metal surface made of nonalloyed titanium is disclosed. The bath composition may comprise sulfuric acid of 2 to 40% by volume, hydrofluoric acid of 10 to 18% by volume and acetic acid of 42 to 62% by volume.

8 Claims, No Drawings

BATH COMPOSITION FOR ELECTROPOLISHING OF TITANIUM AND METHOD FOR USING SAME

FIELD OF THE INVENTION

The present invention relates to a bath composition for the electropolishing of a metal surface made of nonalloyed titanium, and to a method of using this bath.

The term "polishing" is understood to mean a treatment for the purpose of reducing the roughness of a metal surface and, thereby, of increasing its brightness with, as a consequence, a lower corrosion sensitivity.

BACKGROUND OF THE INVENTION

Apart from the mechanical means used for this purpose (the use of abrasive powders of decreasing particle size, fine machining, honing, etc.), there are also techniques which rely on the use of chemical and/or electrolytic reactions. Thus, the technique is named "chemical polishing" when the reactions generated do not rely on an external current source and the technique named "electropolishing" when the reactions depend on an external current source, one of the electrodes (generally that connected to the positive pole of the electric current source) consisting of the workpiece to be polished.

The present invention falls within the technical context of electropolishing.

Electropolishing relies on two simultaneous and opposing reactions in which the relative rates and the diffusion phenomena at the metal/solution interface control the operating process. One of these reactions is a dissolution reaction during which the metal passes into solution in the form of ions; the other reaction is an oxidation reaction during which an oxide layer forms, this layer being protective to a greater or lesser extent and limiting, when it is present, the progress of the first reaction. These two, opposing and complex, reactions come into competition with the consequence that the chemical etching undergone by the metal surface is self-limiting, polishing being merely one particular result of this etching.

The polishing obtained electrolytically is substantially influenced by the viscosity and/or resistivity of the electrolyte employed. It is known to use various acid compositions, especially compositions based on hydrofluoric, sulfuric, nitric and phosphoric acids in various concentrations. Some of these acids (for example hydrofluoric acid) allow the oxide layer formed on the metal surface to be dissolved, whereas other acids (for example phosphoric acid, sulfuric acid, etc.) form the viscous medium necessary for the electropolishing to progress. It is essential for the concentrations of the constituents of the electrolytes to be correctly controlled in order to ensure that the process progresses properly and to determine the lifetime of these electrolytes.

Many electropolishing bath compositions are known (see for example U.S. Pat. Nos. 3,766,030, 3,864,238, 5,591,320, 5,565,084, etc.). Some of these known compositions are multipurpose and allow both pure titanium and its alloys to be treated. Because of this, the quality of action of these baths is the result of a compromise and polishing of the metal surfaces treated is not optimal.

SUMMARY OF THE INVENTION

The object of the present invention is therefore essentially to provide a bath composition for the specific electropolishing of nonalloyed titanium so as to obtain a metal surface having a high-quality and measurable degree of polishing, but also so as to obtain, by an appropriate choice of the electrical parameters when using the composition, metal surfaces having a roughness which is predeterminable ("adjustable") and measurable (for example in the case of biocompatible body implants made of titanium).

DETAILED DESCRIPTION OF THE INVENTION

For these purposes, a bath composition for the electropolishing of a metal surface made of nonalloyed titanium is characterized, in accordance with the invention, in that it comprises:

- sulfuric acid (95 to 98% solution): 20 to 40 vol %, this acid having slight oxidizing properties and a high viscosity;
- hydrofluoric acid (40 to 48% solution): 10 to 18 vol %, this acid giving rise to salts which are soluble; and
- acetic acid (90 to 100% solution): 42 to 62 vol %, suitable for modifying the electrochemical equilibria at the solution/metal interface, acetic acid allowing a better control of the oxidation and the dissolution of the titanium surface and resulting in self-limitation of the chemical dissolution of the metal surface, the polishing of the metal surface being one of the results thereof.

The solution and concentration characteristics of the sulfuric and hydrofluoric acids are tailored to the type of metal to be polished (nonalloyed titanium).

None of the formulations known from the prior art employs acetic acid for specifically polishing titanium. Acetic acid, owing to its chemical properties (low dissociation, etc.), allows a better regulation of the electrochemical processes employed while the titanium is undergoing electropolishing.

Advantageously, an addition agent called a "cationic wetting agent", for example a quaternary ammonium salt such as cetyltrimethylammonium bromide or a substituted derivative such as hexadecylpyridinium bromide, in an amount ranging from 0.1 to 0.5 g/l, may also be added to the aforementioned bath composition. This agent modifies the polarization of one of the two electrodes (alternate adsorption and desorption phenomena) in the medium and leads to modifications in the double-layer phenomena. As a result, the quality of the polishing is improved and less metal is removed.

When employing the aforementioned bath composition, the following conditions should be combined:

- bath temperature between 20 and 22° C., so that the necessary equilibrium between the rate of oxidation and the rate of dissolution of the oxide layer formed is not disturbed;
- anode current density about 7 A/dm;
- polishing electrical voltage (inter-electrode voltage) about 11 volts, these electrical characteristics (current density and voltage) being tailored according to the shape of the surfaces to be polished and/or to the possible use of one or more auxiliary anodes;
- moderate stirring of the bath, this being able to be adapted for each specific application, so as to maintain the stability of the viscous layer at the interface between the electrode (surface to be polished) and the liquid solution (a too vigorous or insufficient stirring would destabilize this interfacial layer and lead to poor polishing results),
- whereby the rate of dissolution of titanium is about 6 microns/min.

Using the means proposed by the invention, it is possible to regulate and control extremely accurately the conditions of electrochemical dissolution of the titanium metal surface and it is also possible to achieve a degree of polishing of titanium which is greatly superior to that allowed by the techniques known hitherto. Thus, to give a specific case, starting from an as-rolled titanium surface having a maximum roughness Rt of around 1 to 2 μm and an average roughness Ra of around 0.1 to 0.15 μm, it is possible to obtain, after electropolishing under the conditions of the invention, a maximum roughness Rt of around 0.5 μm and an average roughness Ra of around 0.05 to 0.10 μm with a dissolved metal thickness of around 50 to 100 pm. Furthermore, and above all, the conditions under which the electropolishing process are carried out are completely controllable so as to obtain a measurable and predeterminable roughness. Finally, the use of an addition agent as indicated above makes it possible, by better control of the conditions under which the process progresses, to remove a smaller thickness of metal in order to achieve a given roughness value.

One specific example of the abovementioned composition, without the addition agent, is as follows:

sulfuric acid: 98% solution; density 1.84; 25 vol %;

hydrofluoric acid: 40% solution; density 1.10; 15 vol %;

glacial acetic acid: 100% solution; density 1.05; 60 vol %.

Roughness measurements taken on a nonalloyed titanium metal surface, before and after electropolishing, gave the following results (Rt=maximum roughness; Ra=average roughness): before polishing

| | | |
|---|---|---|
| before polishing (as - rolled surface): | Rt = 1.80 μm | Ra = 0.176 μm |
| after polishing (metal thickness dissolved = 22 μm): | Rt = 0.670 μm | Ra = 0.080 μm |
| after polishing (metal thickness dissolved = 59 μm): | Rt = 0.396 μm | Ra = 0.057 μm |
| after polishing (metal thickness dissolved = 116 μm): | Rt = 0.432 μm | Ra = 0.080 μm. |

What is claimed is:

1. A bath composition for the electropolishing of a metal surface made of nonalloyed titanium, comprising:

sulfuric acid: 95 to 98% solutions, 20 to 40 vol %;

hydrofluoric acid: 40 to 48% solution; 10 to 19 vol %; and acetic acid: 90 to 100% solutions; 42 to 62 vol %, suitable for modifying the electrochemical equilibria at the solution/metal interface, acetic acid allowing better control of the oxidation and the dissolution of the titanium surface and resulting in self-limitation of the chemical dissolution of the metal surface.

2. The composition as claimed in claim 1, comprising:

sulfuric acid: 98% solution; density 1.84; 25 vol %;

hydrofluoric acid: 40% solution; density 1.10; 15 vol %;

glacial acetic acid: 100% solution; density 1.05; 60 vol %.

3. The composition as claimed in claim 1, further including an addition agent chosen from cetyltrimethylammonium bromide and hexadecylpridinium bromide, in an amount ranging from 0.1 to 0.5 g/l.

4. The composition as claimed in claim 2, further including an addition agent chosen from cetyltrimethylammonium bromide and hexadecylpyridinium, in an amount ranging from 0.1 to 0.5 g/l.

5. A method of using bath composition for the electropolishing of titanium, the bath composition comprising: sulfuric acid, 95–98% solution, 20–40 vol %; hydrofluoric acid, 40–48% solution, 10–19vol %; and acetic acid, 90–100%, solution, 42–62vol %, suitable for modifying electrochemical equilibria at the solution/metal interface, acetic acid allowing better control of the oxidation and the dissolution of the titanium surface and resulting in self-limitation of the chemical dissolution of the metal surface, the method comprising:

providing a bath temperature between about 20° C. and 22° C.;

providing a current density of about 7 A/dm$^2$;

providing a polishing voltage of about 11 volts; and stirring the bath moderately, whereby the rate of dissolution of the titanium is about 6 microns/min.

6. A method of using a bath composition for the electropolishing of titanium, the bath composition comprising: sulfuric acid, 98% solution, density 1.84, 25 vol %; hydrofluoric acid, 40% solution, density 1.10, 15 vol %; and glacial acetic acid, 100% solution, density 1.05, 60 vol %, the bath composition comprising:

providing a bath temperature between about 20° C. and 22° C.;

providing a current density of about 7 A/dm$^2$;

providing a polishing voltage of about 11 volts; and stirring the bath moderately, whereby the rate of dissolution of the titanium is about 6 microns/min.

7. A method of using a bath composition for the electropolishing of titanium, the bath composition comprising: sulfuric acid, 95–98% solution 20–40 vol %; hydrofluoric acid, 40–48% solution, 10–19 vol %; and acetic acid, 90–100% solution. 42–62 vol %, suitable for modifying electrochemical equilibria at this solution/metal interface, acetic acid allowing better control of the oxidation and the dissolution of the titanium surface and resulting in self-limitation of the chemical dissolution of the metal surface, and an addition agent chosen from the cetyltrimethylammonium bromide and hexadecylpyridinium bromide in amount ranging from 0.1–0.5 g/l, the bath composition comprising: providing a bath temperature between about 20° C. and 22° C.;

providing a current density of about 7 A/dm$^2$;

providing a polishing voltage of about 11 volts; and stirring the bath moderately whereby the rate of dissolution of the titanium is about 6 microns/min.

8. A method of using a bath composition for the electropolishing of titanium, the bath composition comprising: sulfuric acid, 98% solution, density 1.84, 25 vol % ; hydrofluoric acid, 40% solution, density 1.10, 15 vol %; and glacial acetic acid, 100% solution, density 1.05, 60 vol %, the bath composition comprising:

providing a bath temperature between about 20° C. and 22° C.;

providing a current density of about 7 A/dm$^2$;

providing a polishing voltage of about 11 volts; and stirring the bath moderately, whereby the rate of dissolution of the titanium is about 6 microns/min.

* * * * *

UNITED STATES PATENT AND TRADEMARK OFFICE

CERTIFICATE OF CORRECTION

PATENT NO. : 6,610,194 B1
DATED : August 26, 2003
INVENTOR(S) : Jean Guerin

It is certified that error appears in the above-identified patent and that said Letters Patent is hereby corrected as shown below:

Column 3,
Line 47, please delete "95 to 98% solutions" and insert -- 95 to 98% solution --.
Line 49, please delete "90 to 100% solutions" and insert -- 90 to 100% solution --.

Signed and Sealed this

Twenty-third Day of December, 2003

JAMES E. ROGAN
*Director of the United States Patent and Trademark Office*